US008900047B1

(12) United States Patent
Ferrell

(10) Patent No.: US 8,900,047 B1
(45) Date of Patent: Dec. 2, 2014

(54) DICE-BASED GAMING SYSTEM

(71) Applicant: Nathaniel Ferrell, Glenwood, IL (US)

(72) Inventor: Nathaniel Ferrell, Glenwood, IL (US)

( * ) Notice: Subject to any disclaimer, the term of this patent is extended or adjusted under 35 U.S.C. 154(b) by 0 days.

(21) Appl. No.: 14/049,457

(22) Filed: Oct. 9, 2013

(51) Int. Cl.
*A63F 9/04* (2006.01)
*G07F 17/32* (2006.01)

(52) U.S. Cl.
CPC ..... *A63F 9/04* (2013.01); *G07F 17/3286* (2013.01)
USPC ..... 463/18; 463/17; 463/22; 273/274

(58) Field of Classification Search
CPC ..... G07F 17/32
USPC ..... 463/22; 273/274
See application file for complete search history.

(56) References Cited

U.S. PATENT DOCUMENTS 4,334,685 A * 6/1982 Robbins et al. ..... 273/274
4,506,890 A * 3/1985 Murry ..... 463/22
5,263,715 A * 11/1993 Matsumoto et al. ..... 463/22
5,308,081 A * 5/1994 Bartle ..... 273/274
5,413,351 A * 5/1995 Franklin ..... 273/274
5,487,547 A * 1/1996 Hobert ..... 273/274
5,490,670 A * 2/1996 Hobert ..... 463/20
5,649,704 A * 7/1997 Dobbin ..... 273/268
5,728,002 A * 3/1998 Hobert ..... 463/17
5,788,240 A * 8/1998 Feinberg ..... 273/274
5,806,847 A * 9/1998 White et al. ..... 273/309
5,829,748 A * 11/1998 Moore, Jr. ..... 273/274
5,879,006 A * 3/1999 Bowling ..... 273/274
5,934,676 A * 8/1999 Rubin ..... 273/309
6,123,335 A * 9/2000 Adkins ..... 273/292
6,173,955 B1 * 1/2001 Perrie et al. ..... 273/146
6,176,489 B1 * 1/2001 Astaneha ..... 273/274
6,213,876 B1 * 4/2001 Moore, Jr. ..... 463/22
6,234,482 B1 * 5/2001 Henderson ..... 273/274
6,273,423 B1 * 8/2001 Promutico ..... 273/274
6,302,395 B1 * 10/2001 Astaneha ..... 273/274
6,305,686 B1 * 10/2001 Perrie et al. ..... 273/146
6,336,633 B1 * 1/2002 Webb ..... 273/274
6,428,005 B2 * 8/2002 Au-Yeung ..... 273/274
6,464,225 B1 * 10/2002 Webb ..... 273/274
6,481,713 B2 * 11/2002 Perrie et al. ..... 273/146
6,508,469 B2 * 1/2003 Promutico ..... 273/274
6,565,088 B2 * 5/2003 Perrie et al. ..... 273/146
6,601,848 B1 * 8/2003 Timmons, Sr. ..... 273/146
6,688,597 B2 * 2/2004 Jones ..... 273/274
6,746,016 B2 * 6/2004 Perrie et al. ..... 273/138.1
6,854,732 B2 * 2/2005 Moody ..... 273/274
6,896,264 B1 * 5/2005 Haber ..... 273/274
6,926,277 B2 * 8/2005 Auricchio ..... 273/274
7,032,901 B2 * 4/2006 Perrie et al. ..... 273/138.1
7,377,513 B2 * 5/2008 Friedman ..... 273/274

(Continued)

*Primary Examiner* — Steven J Hylinski
(74) *Attorney, Agent, or Firm* — Patents+TMS, P.C.

(57) ABSTRACT

A new dice-based wagering system that requires six dice and a layout indicating payout amounts when the correct totals for the six dice are rolled. When rolling six dice the lowest possible total is six (6) and the highest possible total is thirty six (36). The object of the game is to place a wager on the correct total the dice will add up to. The payout ranges from nine times your wager to forty thousand times your wager on a specific number. The game also has "outside bets". These are wagers that are not placed on a specific number but on groups of numbers or colors of numbers. There are five outside wagers. (ODD or EVEN), (RED or BLACK), (HIGH or LOW), Horizontal Row bets and Vertical Column Bets available.

16 Claims, 10 Drawing Sheets

(56) References Cited

U.S. PATENT DOCUMENTS

| | | | | |
|---|---|---|---|---|
| 7,401,781 | B2 * | 7/2008 | Guyer et al. | 273/146 |
| 7,520,507 | B2 * | 4/2009 | Gak | 273/146 |
| 7,601,057 | B2 * | 10/2009 | Kaminkow | 463/16 |
| 7,828,294 | B2 * | 11/2010 | Nicely et al. | 273/146 |
| 7,963,848 | B2 * | 6/2011 | Yoshizawa | 463/27 |
| 8,074,985 | B2 * | 12/2011 | Guyer | 273/146 |
| 8,074,991 | B2 * | 12/2011 | Chen et al. | 273/274 |
| 8,118,309 | B1 * | 2/2012 | Friedman | 273/274 |
| 8,162,732 | B1 * | 4/2012 | Juds et al. | 463/10 |
| 8,257,166 | B2 * | 9/2012 | Kido | 463/22 |
| 8,342,524 | B2 * | 1/2013 | Guyer et al. | 273/146 |
| 8,413,987 | B2 * | 4/2013 | Guyer et al. | 273/146 |
| 8,474,820 | B2 * | 7/2013 | Walker et al. | 273/274 |
| 8,613,449 | B2 * | 12/2013 | Brodrick | 273/274 |
| 2001/0035604 | A1 * | 11/2001 | Jones | 273/139 |
| 2002/0036380 | A1 * | 3/2002 | Perrie et al. | 273/146 |
| 2002/0163127 | A1 * | 11/2002 | Perrie et al. | 273/274 |
| 2003/0107172 | A1 * | 6/2003 | Moody | 273/146 |
| 2003/0155708 | A1 * | 8/2003 | Perrie et al. | 273/138.1 |
| 2004/0195763 | A1 * | 10/2004 | Perrie et al. | 273/138.1 |
| 2005/0146092 | A1 * | 7/2005 | Knight | 273/145 R |
| 2008/0217851 | A1 * | 9/2008 | Colton | 273/274 |
| 2010/0148442 | A1 * | 6/2010 | Walker et al. | 273/274 |
| 2010/0203965 | A1 * | 8/2010 | Juds et al. | 463/31 |
| 2011/0278794 | A1 * | 11/2011 | Brodrick | 273/274 |
| 2012/0104694 | A1 * | 5/2012 | Horbury | 273/274 |
| 2013/0140772 | A1 * | 6/2013 | Chewoian | 273/274 |

* cited by examiner

200

| 210 | 220 | 230 | 240 | 250 |
|---|---|---|---|---|
| 6 | 1 / 46656 | 0.0000214 | 40,000 to 1 | 14.26% |
| 7 | 6 / 46656 | 0.0001286 | 7,000 to 1 | 9.96% |
| 8 | 21 / 46656 | 0.0004501 | 2,150 to 1 | 3.18% |
| 9 | 56 / 46656 | 0.0012003 | 800 to 1 | 3.86% |
| 10 | 126 / 46656 | 0.0027006 | 350 to 1 | 5.21% |
| 11 | 252 / 46656 | 0.0054012 | 175 to 1 | 4.94% |
| 12 | 456 / 46656 | 0.0097737 | 96 to 1 | 5.20% |
| 13 | 756 / 46656 | 0.0162037 | 58 to 1 | 4.40% |
| 14 | 1161 / 46656 | 0.0248843 | 37 to 1 | 5.44% |
| 15 | 1666 / 46656 | 0.0357082 | 26 to 1 | 3.59% |
| 16 | 2247 / 46656 | 0.0481610 | 19 to 1 | 3.68% |
| 17 | 2856 / 46656 | 0.0612140 | 15 to 1 | 2.06% |
| 18 | 3431 / 46656 | 0.0735382 | 12 to 1 | 4.40% |
| 19 | 3906 / 46656 | 0.0837191 | 10 to 1 | 7.91% |
| 20 | 4221 / 46656 | 0.0904707 | 9 1/2 to 1 | 5.01% |
| 21 | 4332 / 46656 | 0.0928498 | 9 1/2 to 1 | 2.51% |
| 22 | 4221 / 46656 | 0.0904707 | 9 1/2 to 1 | 5.01% |
| 23 | 3906 / 46656 | 0.0837191 | 10 to 1 | 7.90% |
| 24 | 3431 / 46656 | 0.0735382 | 12 to 1 | 4.40% |
| 25 | 2856 / 46656 | 0.0612140 | 15 to 1 | 2.06% |
| 26 | 2247 / 46656 | 0.0481610 | 19 to 1 | 3.68% |
| 27 | 1666 / 46656 | 0.0357082 | 26 to 1 | 3.59% |
| 28 | 1161 / 46656 | 0.0248843 | 37 to 1 | 5.44% |
| 29 | 756 / 46656 | 0.0162037 | 58 to 1 | 4.40% |
| 30 | 456 / 46656 | 0.0097737 | 96 to 1 | 5.20% |
| 31 | 252 / 46656 | 0.0054012 | 175 to 1 | 4.94% |
| 32 | 126 / 46656 | 0.0027006 | 350 to 1 | 5.21% |
| 33 | 56 / 46656 | 0.0012003 | 800 to 1 | 3.86% |
| 34 | 21 / 46656 | 0.0004501 | 2,150 to 1 | 3.18% |
| 35 | 6 / 46656 | 0.0001286 | 7,000 to 1 | 9.96% |
| 36 | 1 / 46656 | 0.0000214 | 40,000 to 1 | 14.26% |

FIG. 2

DICE-BASED GAMING SYSTEM

BACKGROUND OF THE INVENTION

Field of the Invention

The present invention relates generally to a combination of dice and roulette-type game and more particularly, is directed to a combination dice and roulette-type table layout that provides more variations in play and in wagering.

Traditional roulette is a multi-outcome/multi-bets game. Its wagering area consists specific numbers; color, odd/even, "0" and "00" bets. There are five outside bets, three pay even money (1 to 1) and two pay (2 to 1). Roulette has 38 specific numbers (1-36), (0 and 00) and 36 inside bets on specific numbers paying 35 to 1. Typically, a $10 bet pays $350 and $25 would pay $875.

Blackjack has a very popular addition wager to the game, the poker hand. For an additional wager, if the dealer's up card and player's two cards form a porker hand, the player is rewarded at a rate 9 to 1. Because of this 9 to 1 payout, players have made this option a must in all the Midwest casinos. Backarack pays 1 to 1. Blackjack also pays 1 to 1 although getting BLACKJACK pays 1 to 1. Craps pass line pays 1 to 1. Blackjack has a new side bet on the dealers up card and player's two cards form, a poker hand which pays 9 to 1. The highest odds bet in craps are two 12's (box cars) or two 2's (snake eyes) it pays 30 to 1. Three card poker's royal flush pays 40 to 1. With a $10 wager these payouts amount to $90 in a winning blackjack poker hand, $300 in craps and $400 for a royal flush, or $225, $750 and $1,000 on a $25 wager.

All above mentioned casino game with moderate reward ratio cannot compare to state lottery, because the later have tremendous high reward ratio, player needs more exciting elements to keep them play more, for example, higher payout rate or lower allowable wagers.

SUMMARY OF THE INVENTION

It is one object of present invention to provide a game with lower allowable bet and higher payout for that bet. In an exemplary embodiment of the present invention, there are 31 choices 6 and 36 pays (40,000 to 1), 7 or 35 pays (7,000 to 1), 8 or 34 pays (2,150 to 1), 9 or 33 pays (800 to 1), 10 or 32 pays (350 to 1), 11 or 31 pays (175 to 1), 12 or 30 pays (96 to 1), 13 or 29 pays (58 to 1), 14 or 28 pays (37 to 1), 15 or 27 pays (26 to 1), 16 or 26 pays (19 to 1), 17 or 25 pays (15 to 1), 18 or 24 pays (12 to 1), 19 or 23 pays (10 to 1), 20, 21 and 22 all pay (9 to 1).

In one embodiment of present invention, a $10 wager could pay $400,000 and $25 could pay $1,000,000. At this time there is no table game with better odds than three card pokers royal flush at 40 to 1. Present invention is about to turn gaming on its head by offering odds of 40,000 to 1.

It is also an objective of present invention to provide players a game that is easy to understand, easy to deal and fun to play. Yet another objective of present invention is to provide a new game method presenting a positive expectation for the house.

Rolling six dice the lowest possible total sum would be 6 (Six ones) and the highest would be 36 (six sixes). This gives players a total of only 31 possible outcomes. Placing 31 wagers would guarantee a win. For example, a player place 31, one dollar bets on thirty one different outcomes is guaranteed a win ranging from $9.50 to $40,000.

In an exemplary embodiment of the present invention, there is disclosed a new wagering method that requires six dice and a layout indicating payout amounts when the correct totals for the six dice are rolled. When rolling six dice the lowest possible total is six (6) and the highest possible total is thirty six (36). The object of the game is to place a wager on the correct total the dice will add up to. The payout ranges from nine times your wager to forty thousand times your wager on a specific number.

In one embodiment, the game also has "outside bets". These are wagers that are not placed on a specific number but on groups of numbers or colors of numbers. There are five outside wagers. (ODD or EVEN): a wager that the next total will be odd or even pays even money (1 to 1). (RED or BLACK): Correctly picking red or black also pays even money (1 to 1). (HIGH or LOW) is a wager that the next total will be HIGH—ABOVE 21 (22 thru 36) or LOW—BELOW 21 (6 thru 20). The house wins on totals of 21 unless you played 21; it pays $9.50.

In another embodiment, another outside bet is the "row" bet, which is a bet on one of the six numbers contained in the five rows on the layout. Just place the wager on the "4 to I" spot at the end of the row and if the total add-up of the roll appear to be any of the six numbers in that row, the reward pays 4 to 1. The last outside bet is the "column" bet. There are six column bets. The two center columns pay 7 for 4. The two middle columns pay "9 to I" and the outer columns pay "200 to 1".

Yet another objective of present invention is to invent a game that can be easily adapted in various gaming formats and media platforms such as single and multi-player video machines, electronic games and devices, lottery terminals, home entertainment software, on line gaming applications and online non-gaming applications.

At a kiosk this game can be played with a minimum wager of a nickel on outside bets or a total of a nickel on inside bets up to the casino's maximum of a $100 or more depending on a particular casino's limit. This game can be played as a table game with the layout spread across the table or as a video game with the layout on a computer monitor and bills or coins deposited into the kiosk.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIG. 2 illustrates payout and house edge table according to an embodiment of the present invention;

DESCRIPTION OF THE PREFERRED EMBODIMENT

One possible commercial name for the dice-based game of present invention is contemplated by the inventor as "Dice for Life", hereinafter referred as "DFL".

Figure 1:
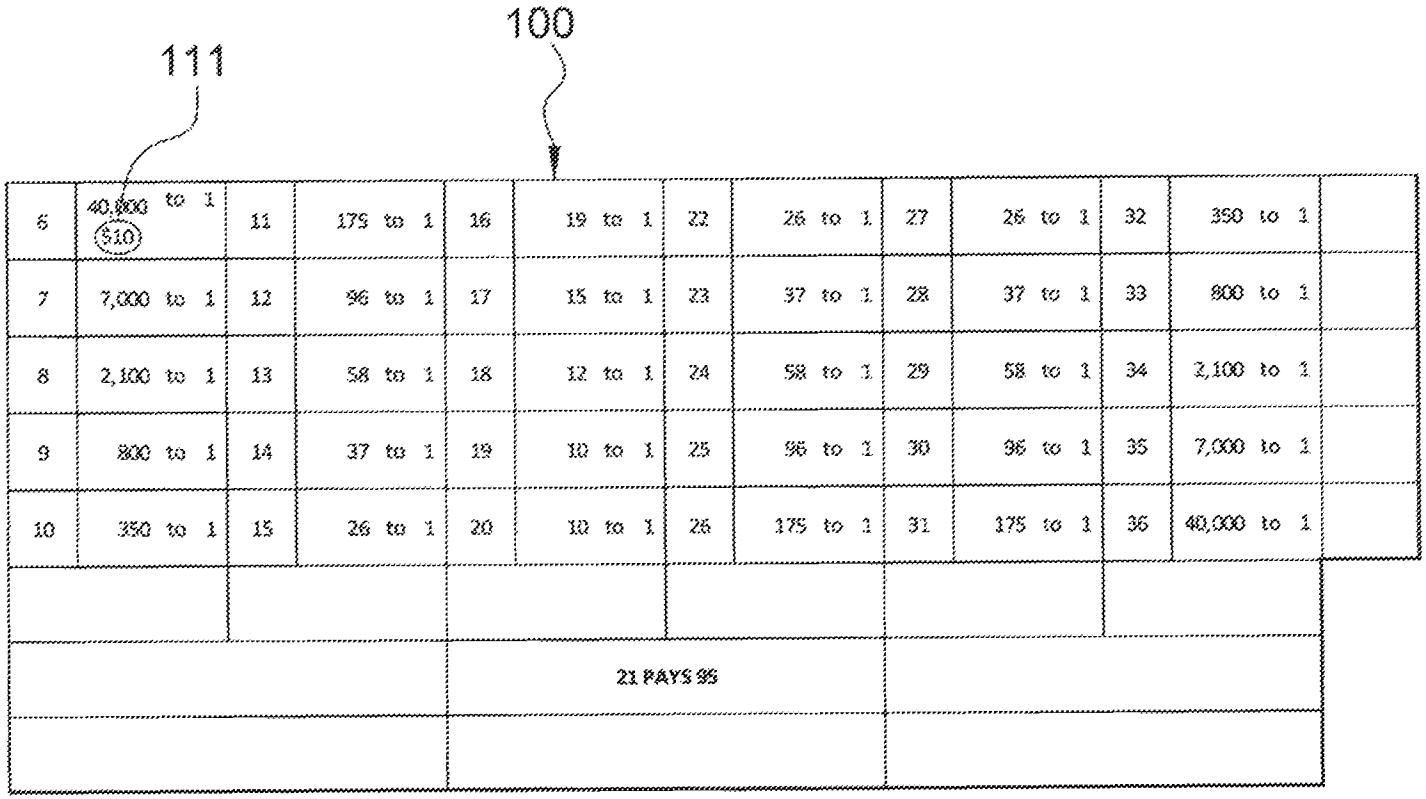
FIG. 1 is a top view of inside betting area with depictive winning payout according to an embodiment of the present invention.

This game "DFL" requires six dice. When rolling six dice all at once, the lowest possible added total is six (6) and the highest possible added total is thirty six (36). There are thirty one (31) single numbers (6 through 36) which are also referred as correct totals indicated in inside betting area. FIG. 1 depicts a layout of inside betting area 100 designed for "DFL" according to an embodiment of the present invention. Inside bets are wagers placed on a specific single number—the correct total. Should a wager be placed on the correct total, a reward (payout) is issued at a rate specified for that correct total. The payout ranges from nine and a half times a wager (9.5 to 1) to forty thousand times a wager (40,000 to 1) on a specific correct total.

Referring to FIG. 1, should either of two correct totals "6" or "36" occur, the payout on a $10 wager 111 is $40,000, and payout for "$25" is $1,000,000. Should a player place 31 wagers at same time, she or he would guarantee a win because there are 31 correct totals by rolling six dice all at once. For example, if a player place thirty one (31) $1 wagers on each and every different correct total, there is a guaranteed win ranging from $9.50 to $40,000.

While the payouts could take any form and are not restricted to any specific form or quantity, FIG. 2 depicts an example payout and house edge table for inside bets on specific numbers according to an embodiment of the present invention. Column 210 represents respective correct totals from 6 to 36. Column 220, 230, and 250 represent house edge in different form. Column 240 represents a payout rate for "DFL".

Figure 3:
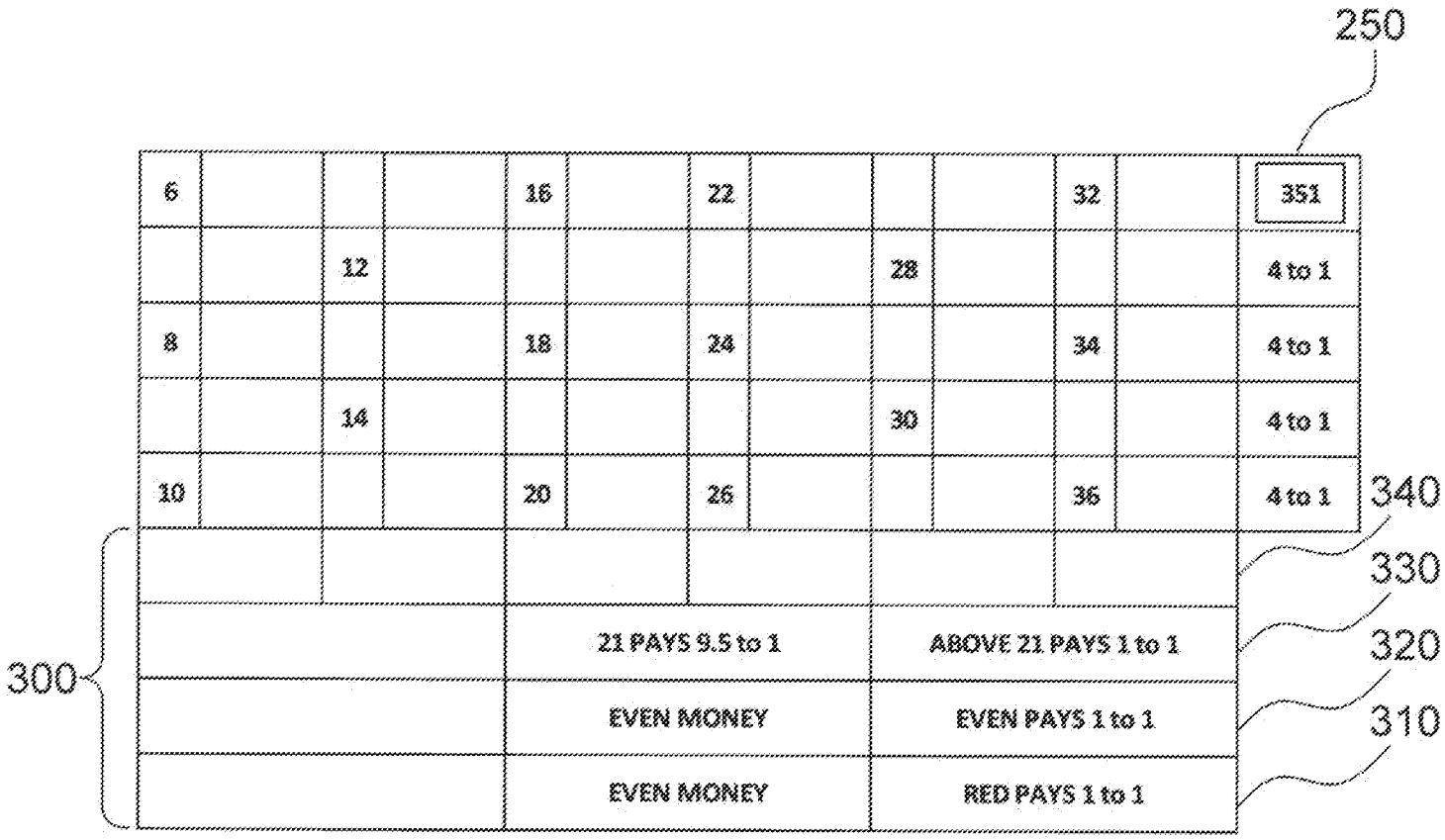
FIG. 3 is a top view of outside betting area with depictive winning payout according to an embodiment of the present invention.

FIG. 3 depicts the outside betting area 300 with depictive payout rate according to an embodiment of the present invention. These five standard attributes of wagers are placed "outside" the 31 single numbers on the layout and feature the groups of numbers or colors, or odd/even. Referring FIG. 3, RED or BLACK 310 is a wager that winning number will be black or red. Other viable color can be selected if so desired. It pays even money 1 to 1. ODD or EVEN 320 is a wager that the winning number will be either odd or even. It pays even money 1 to 1. LOW or HIGH 330 is a wager that the winning number will be low, BELOW 21 (6-20) or high, ABOVE 21 (22-36); it pays even money.

ROWS 350 is laid on the right side of inside betting area. There are five horizontal rows, which are five groups of numbers. For example, if a wager 351 is placed on the row contain single numbers {6-11-16-22-27-32), should any number from that group is the correct total, the player wins and it pays 4 to 1. COLUMN 340 is laid underneath the bottom line of inside betting area. There are six vertical columns, which are six groups of numbers; it pays 7 for 4 for inner rows, (9 to 1) for middle rows and (200 to 1) for outside rows. The inner rows are {16, 17, 18, 19, 20) and {22, 23, 24, 25, 26) respectively. The middle rows are group {11, 12, 13, 14, 15} and {27, 28, 29, 30, 31) respectively. The outside rows are {6, 7, 8, 9, 10) and {32, 33, 34, 35, 36) respectively.

Figure 4:
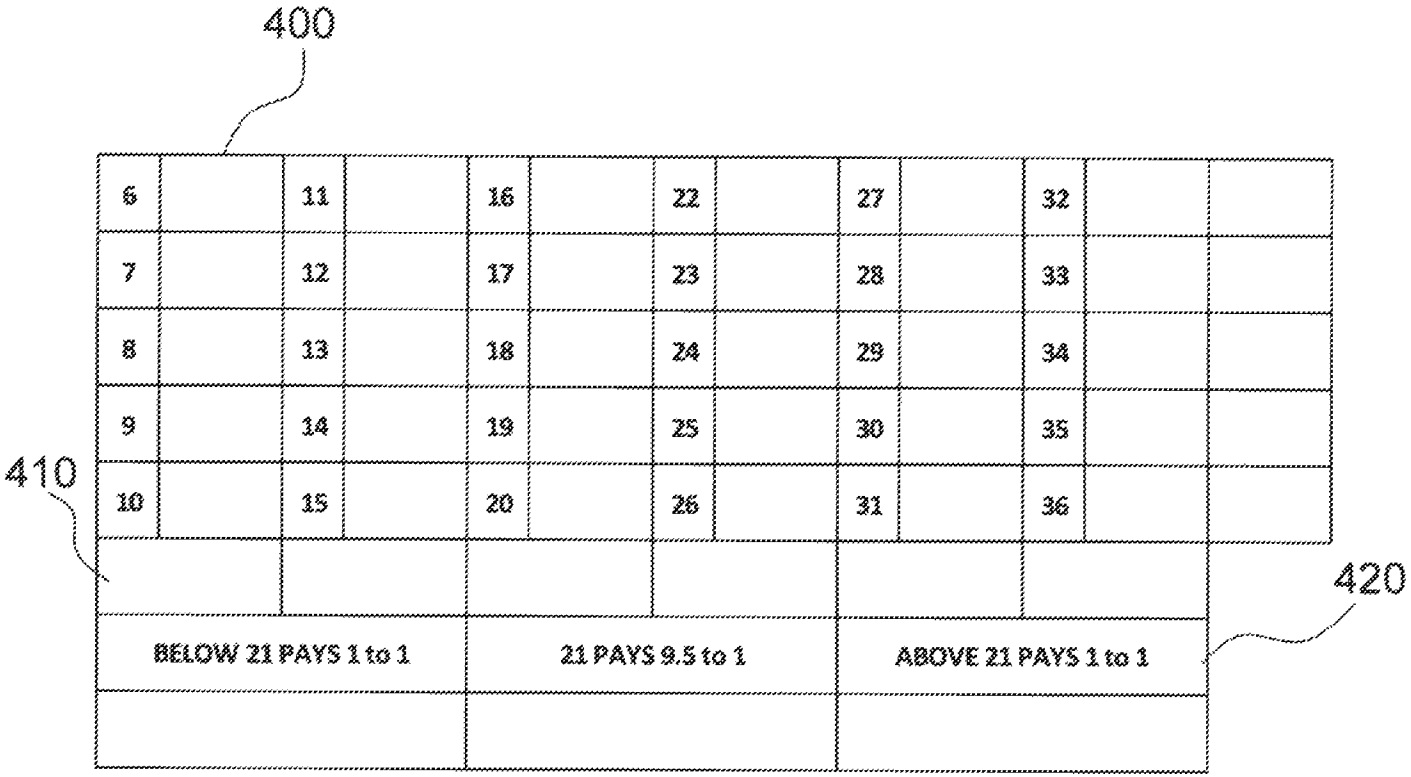
FIG. 4 is a top view of outside betting area featuring group of numbers High or Low according to an embodiment of the present invention.

FIG. 4 depicts outside betting area featuring group of numbers High or Low 400 of the present invention. In one embodiment, low group 410 is 6 through 20 and high group 420 is 22 through 36. House wins if a correct total "21" occurs unless player place wager on it too.

Figure 5:
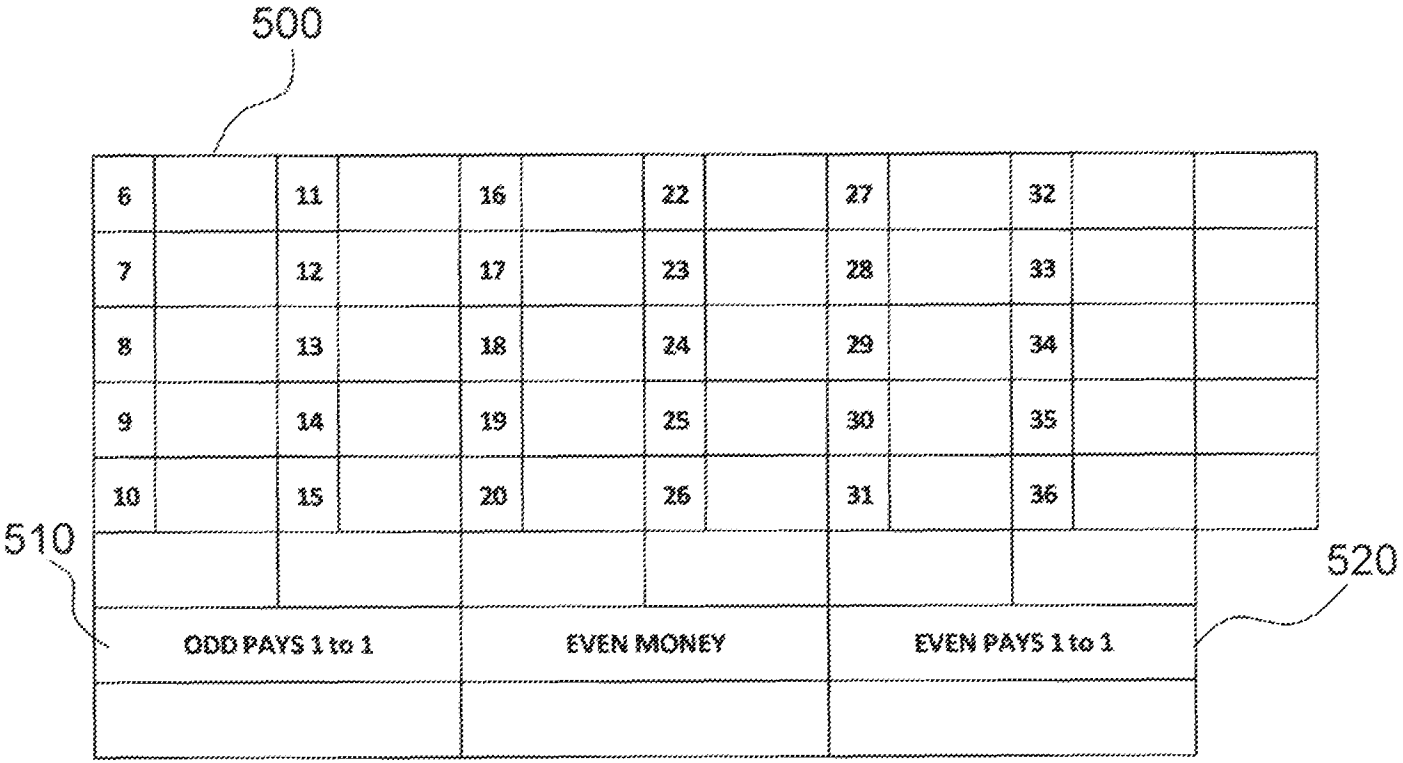
FIG. 5 is a top view of outside betting area featuring group of numbers Odd or Even according to an embodiment of the present invention.

FIG. 5 depicts outside betting area featuring group of numbers Odd or Even 500 the present invention. In one embodiment, players correctly bet on odd 510 or even 520 numbers of totals wins even money (1 to 1). House wins on total of twenty one (21).

Figure 6:
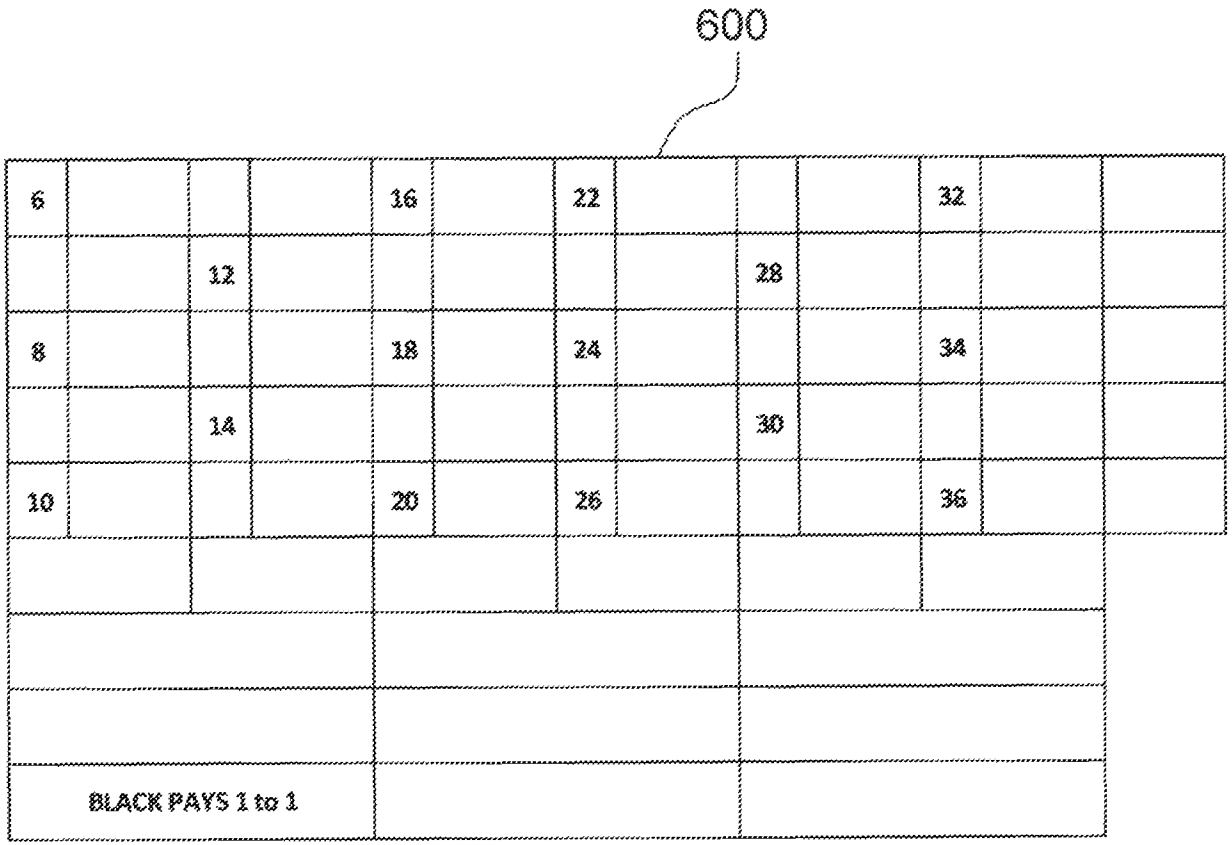
FIG. 6 is a top view of outside betting area featuring color of numbers Red or Black according to an embodiment of the present invention.

FIG. 6 depicts outside betting area featuring color of numbers Red or Black 600 of the present invention. In one embodiment, correct totals (7, 9, 11, 13, 15, 17, 19, 22, 24, 26, 28, 30, 32, 34, and 36) are designated as color red. And correct totals (6, 8, 10, 12, 14, 16, 18, 23, 25, 27, 29, 31, 33, and 35) are designated as color black. Player who correctly bet on correct colors of the totals wins even money (1 to 1). House wins on total of twenty one (21).

Figure 7:
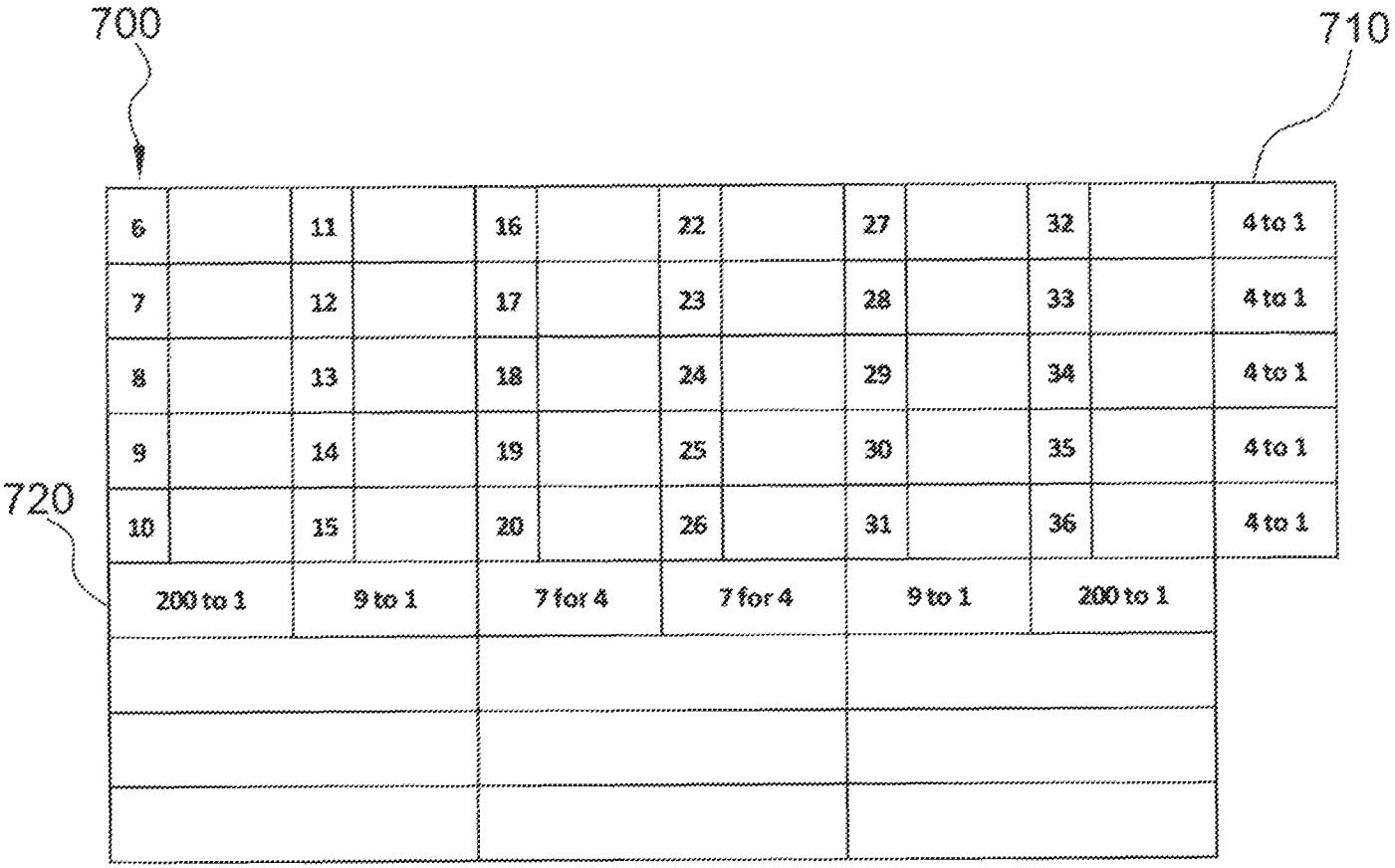
FIG. 7 is a top view of outside betting area featuring vertical columns and horizontal rows according to an embodiment of the present invention.

FIG. 7 depicts outside betting area featuring vertical columns 710 and horizontal rows 720 without showing other outside betting attributes. House edge in vertical columns 1030, 1031 paying 7 for 4 is 7.19%; House edge in vertical columns 1020, 1021 paying 9 to 1 is 8.02%; House edge in vertical columns 1010, 1011 paying 200 to 1 is 9.52%. In one embodiment of present invention, column 1010 contains number group {6, 7, 8, 9, 10); column 1011 contains number group {32, 33, 34, 35, 36); column 1020 contains number group {11, 12, 13, 14, 15); column 1021 contains number group {27, 28, 29, 30, 31); column 1030 contains number group {16, 17, 18, 19, 20); column 1031 contains number group {22, 23, 24, 25, 26).

Figure 8:
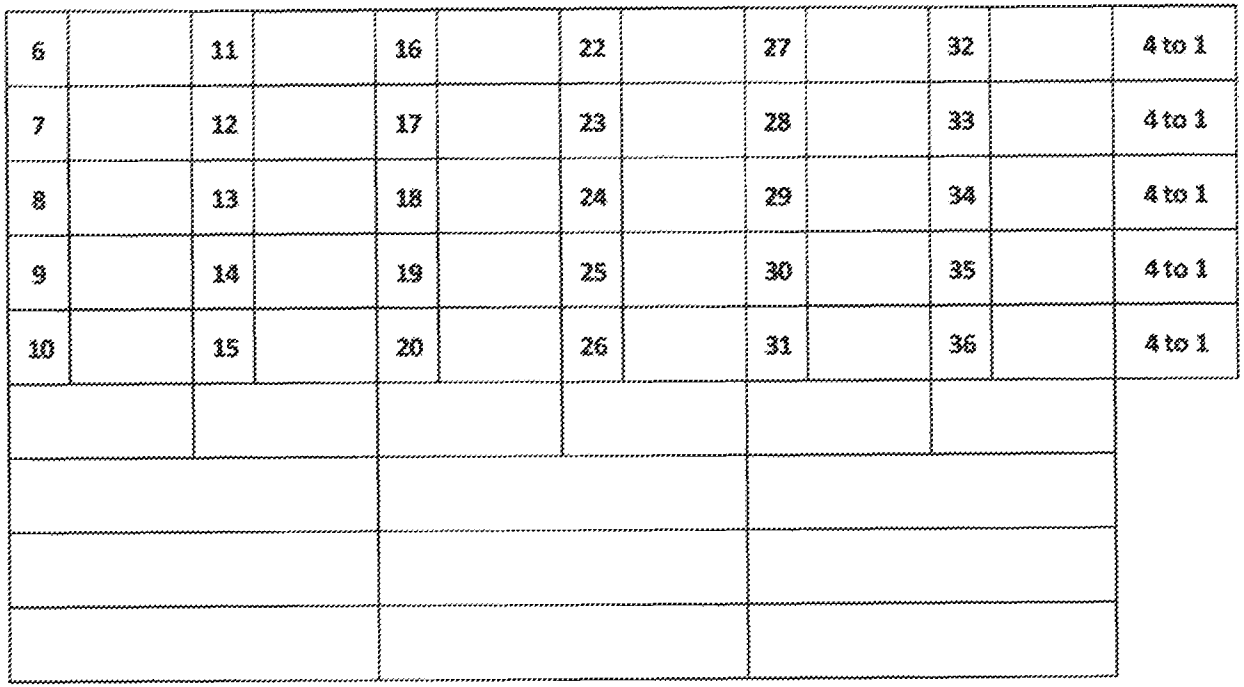
FIG. 8 is a depictive view of winning payout on outside bets featuring horizontal row group number according to an embodiment of the present invention.

FIG. 8 depicts house edge on outside bets featuring horizontal row group number according to an embodiment of the present invention. House edge in row {6-11-16-22-27-32) is 8.76%; House edge in row {7-12-17-23-28-33) is 9.54%; House edge in row {8-13-18-24-29-34) is 9.80%; House edge in row {9-14-19-25-30-35) is 9.54%; and House edge in row {10-15-20-26-31-36) is 8.76%.

Figure 9:
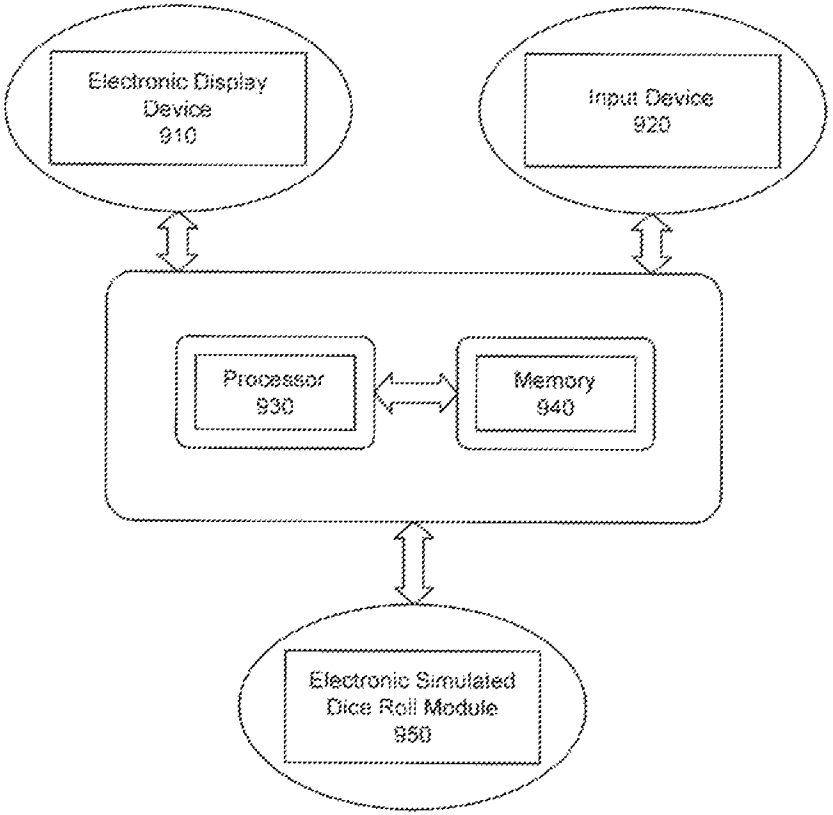
FIG. 9 is a functional diagram of a dice-based gaming system according to an embodiment of the present invention.

FIG. 9 is a functional diagram of an example dice-based gaming system 900. In one embodiment, the gaming system 900 comprises at least one display 910, at least one input device 920 (optional), at least one processor 930, at least one memory 940 and one optional electronic simulated dice roll module 950. The at least one memory device 940 which stores a series of instructions, which when executed by said at least one processor 930, cause said at least one processor 930 to operate with said at least one display device 910 to:

(a) display a plurality of betting areas as depicted in FIG. 1 thru 8, (b) display a plurality of wagering values as depicted in FIG. 1 thru 8;

(c) display a plurality of payout ratios, each payout ratios being associated with one of said betting area in FIG. 1 thru 8;

(d) receive the value of total after rolling of said six dice or generate a correct total by executing the electronic simulated dice roll module 950; and (e) display the total of each roll on said display device 910.

The at least one input device 920 may be electronically connected to said processor 930 and said memory 940. The at least one processor 930 when executed, causes said at least one input device 920 to receive wagers. Said at least one input device 920 receives wagers in different forms, ranging from house specified chips, cash in house permitted values, coin in house permitted values, or electronically simulated wagers together with operational computer code stored in said at least one memory 940.

The gaming system is intended to be adapted in various gaming formats and media platforms such as single and multi-player video machines, electronic games and devices, lottery terminals, home entertainment software, on line gaming applications and online non-gaming applications.

Figure 10:
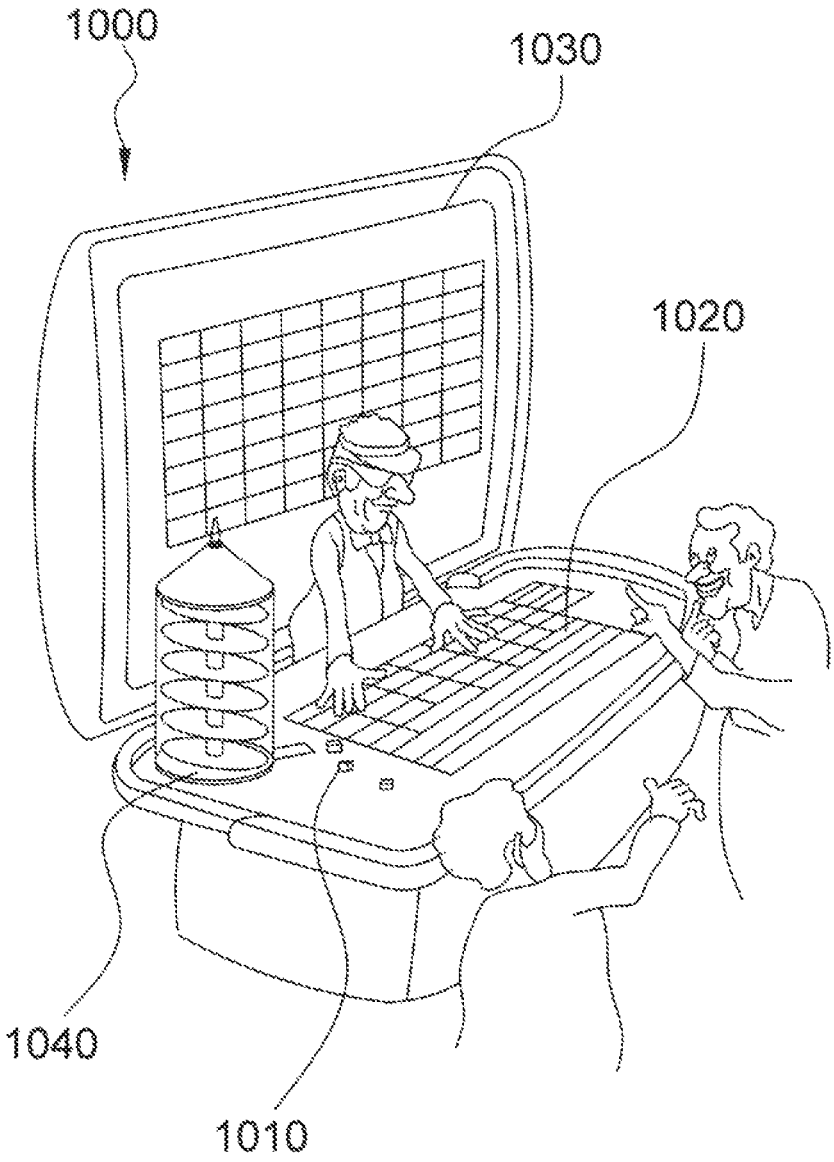
FIG. 10 is perspective view of the dice-based gaming system according to an embodiment of the present invention.

FIG. 10 depicts an example gaming system 1000 of present invention. In one embodiment, the gaming system 1000 comprises a wagering table 1020 with inside and outside betting areas depicted in FIG. 1 through 8; six standard dice 1010, each has six sides with various values ranging from 1 to 6; a display board 1030 hanging or positioned on a stand high enough (6 feet from the ground) for player's easy eye access, and a dedicated dice roll device 1040.

Referring to FIG. 10, dealers are required to wait about two minutes before releasing the dice. The dealer marks the winning number with a marker. Players are not allowed to place bet for the next roll until the dealer removes the marker from the previous winning number. The players better make sure to wait for the dealer to pick it up before putting down the chips. All winning outside bets are paid by the dealer. Inside bets are paid by the dealer in the form of a coupon which is exchanged for a cash payout at the cashier's window after all necessary taxes and adjustments have been deducted.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A dice-based gaming system comprising:

six dice, wherein each of the dice present six numbers with values ranging from one to six;

a display device;

a processor;

a memory device which stores a series of instructions that causes the processor to operate with the display device to display a plurality of betting areas, display a plurality of wagering values, display a plurality of payout ratios associated with a plurality of house edges, wherein each payout ratio of the plurality of payout ratios is associated with a betting area of the plurality of betting areas wherein the plurality of betting areas have a first row associated with a first house edge, a second row associated with a second house edge, a third row associated with a third house edge wherein the second house edge is greater than the first house edge and the third house edge is greater than the second house edge, receive a total value calculated by adding the values shown by each of the dice after simultaneously rolling the six dice, and display the total value on the display device;

an input device that receives the wager wherein the input device is electronically connected to the processor and the memory device; and an outcome displayed by the display device wherein the outcome is determined by finding a match between the wager received by the input device and the total value.

2. The dice-based gaming system of claim 1, further comprising:

a betting chip permitted by the house wherein the betting chip is used to provide the wager; and an electronically simulated wager stored in the memory.

3. The dice-based gaming system of claim 1 adapted to be selected from a group including: single and multi-player video machines, electronic games and devices, lottery terminals, home entertainment software, online gaming applications, and online non-gaming applications.

4. A dice-based gaming system comprising:

six dice wherein each of the dice has six sides with consecutive values shown on each side ranging from one through six and further wherein a total value of the dice within the range of six through thirty-six inclusive is calculated by adding the values shown by each of the dice after simultaneously rolling the six dice and further wherein a winner is determined by a bet that matches the total value of the dice;

a wagering area on a gaming table wherein the gaming table has a surface wherein the wagering area forms a portion of the surface of the gaming table wherein the wagering area is associated with a payout ratio used to calculate a house edge wherein the wagering area has a first row associated with a first house edge, a second row associated with a second house edge, a third row associated with a third house edge wherein the second house edge is greater than the first house edge and the third house edge is greater than the second house edge;

an inside betting area on the gaming table wherein the inside betting area forms a portion of the surface of the gaming table; and a viewable display board on a stand adjacent to the gaming table.

5. The dice-based gaming system of claim 4 further comprising: a dedicated dice rolling device adjacent to the gaming table.

6. The dice-based gaming system of claim 4 further comprising:

an outside betting area on the gaming table wherein the outside betting area has a HIGH/LOW zone.

7. The dice-based gaming system of claim 6 wherein a low wager on the outside betting area with a HIGH/LOW zone is defined where the total value is below twenty-one, and a high wager on the outside betting area with a HIGH/LOW zone is defined where the total value is above twenty-one.

8. The dice-based gaming system of claim 4 further comprising:

an outside betting area on the gaming table wherein the outside betting area has an ODD/EVEN attributes zone.

9. The dice-based gaming system of claim 4 further comprising:

an outside betting area on the gaming table wherein the outside betting area has a color.

10. The dice-based gaming system of claim 9 wherein the color is red.

11. The dice-based gaming system of claim 4 further comprising:

an outside betting area on the gaming table with a group of numbers.

12. The dice-based gaming system of claim 11 wherein the group of numbers form horizontal rows.

13. The dice-based gaming system of claim 12 wherein the horizontal rows have a first group of numbers, a second group of numbers, a third group of numbers, a fourth group of numbers, and a fifth group of numbers wherein no numbers in the first group of numbers, the second group of numbers, the third group of numbers, the fourth group of numbers, and the fifth group of numbers are the same.

14. The dice-based gaming system of claim 11 where the groups of numbers form vertical columns.

15. The dice-based gaming system of claim 14 wherein the vertical columns have a first group of numbers, a second group of numbers, a third group of numbers, a fourth group of numbers, a fifth group of numbers, and a sixth group of numbers, wherein no numbers in the first group of numbers, the second group of numbers, the third group of numbers, the fourth group of numbers, the fifth group of numbers, and the sixth group of numbers are the same.

16. The dice-based gaming system of claim 15 wherein payout for the inner rows is paid at a first ratio, for the middle rows is paid at a second ratio, and for the outside rows is paid at a third ratio wherein the third ratio is greater than the first ratio and the further wherein the third ratio is greater than the second ratio.

* * * * *